US005857801A

United States Patent [19]

Brown

[11] Patent Number: 5,857,801

[45] Date of Patent: Jan. 12, 1999

[54] ROADWAY REFLECTOR

[75] Inventor: Howard R. Brown, Bowling Green, Ohio

[73] Assignee: The D.S. Brown Company, Baltimore, Ohio

[21] Appl. No.: 832,435

[22] Filed: Apr. 3, 1997

[51] Int. Cl.[6] ..... E01F 9/07

[52] U.S. Cl. ..... 404/11; 404/14

[58] Field of Search ..... 404/10, 11, 12, 404/13, 14, 15, 16

[56] References Cited

U.S. PATENT DOCUMENTS

| | | | |
|---|---|---|---|
| 1,886,721 | 11/1932 | O'Brien . | |
| 2,192,878 | 3/1940 | Beebe . | |
| 2,224,554 | 12/1940 | Stedman . | |
| 2,664,065 | 12/1953 | Thompson . | |
| 2,941,447 | 6/1960 | Abbott, Sr. . | |
| 2,981,149 | 4/1961 | Stolarczyk et al. . | |
| 3,011,412 | 12/1961 | Harrington et al. . | |
| 3,212,415 | 10/1965 | Byrd | 404/10 |
| 3,216,335 | 11/1965 | Stolarczyk et al. . | |
| 3,257,552 | 6/1966 | Converso | 404/10 X |
| 3,292,506 | 12/1966 | Kone | 404/11 |
| 3,377,930 | 4/1968 | Kone | 404/11 |
| 3,499,371 | 3/1970 | Jonnes et al. . | |
| 3,502,008 | 3/1970 | Macrae . | |
| 3,564,984 | 2/1971 | Alexander | 94/1.5 |
| 3,703,855 | 11/1972 | Converso . | |
| 3,717,076 | 2/1973 | Shields et al. | 94/1.5 |
| 3,850,536 | 11/1974 | Kone | 404/11 |
| 3,877,785 | 4/1975 | Schaefer . | |
| 3,922,066 | 11/1975 | Schaefer . | |
| 3,971,623 | 7/1976 | Hedgewick et al. . | |
| 4,012,114 | 3/1977 | Eigemann . | |
| 4,070,095 | 1/1978 | Suhr . | |
| 4,071,302 | 1/1978 | Allegri, Sr. . | |
| 4,080,085 | 3/1978 | Dickson . | |
| 4,284,365 | 8/1981 | Rabinow . | |
| 4,303,305 | 12/1981 | Jones . | |
| 4,428,320 | 1/1984 | Oplt et al. . | |
| 4,498,733 | 2/1985 | Flanagan . | |
| 4,504,169 | 3/1985 | Jones . | |
| 4,557,624 | 12/1985 | Walker . | |
| 4,566,820 | 1/1986 | Egan et al. . | |
| 4,573,763 | 3/1986 | Thomas . | |
| 4,595,312 | 6/1986 | Corless . | |
| 4,597,691 | 7/1986 | Clarke . | |
| 4,653,955 | 3/1987 | Racs . | |
| 4,737,049 | 4/1988 | Callhan . | |
| 4,818,138 | 4/1989 | Brown . | |
| 4,854,768 | 8/1989 | Flanagan et al. . | |
| 4,871,280 | 10/1989 | Modlin . | |
| 4,875,798 | 10/1989 | May . | |
| 4,955,982 | 9/1990 | Paulos . | |
| 5,002,424 | 3/1991 | Hedgewick . | |

(List continued on next page.)

FOREIGN PATENT DOCUMENTS

| | | |
|---|---|---|
| WO 97/333045 | 9/1997 | WIPO . |

*Primary Examiner*—James Lisehora
*Attorney, Agent, or Firm*—Wood, Herron and Evans, L.L.P.

[57] ABSTRACT

A roadway reflector is both durable and easily embedded into an opening in a roadway. The roadway reflector in one presently preferred embodiment is preferably circular or disk shaped so it can be inserted into a preformed circular hole in the roadway. A reflector includes two primary components, one of which is an upper member which can be easily coupled to the base member by a plurality of mating tabs and notches in the respective components. An expansion ring is inserted into the base member to expand the base member into a friction fit with the opening in the roadway. A resilient membrane or web is included in the base member and surrounds the upper reflective member so that as a snow plow blade, vehicle tire or the like passes over the reflector, the upper member is depressed downwardly into a cavity in the base member. After the item passes the reflector, the resilient membrane flexes similar to a hinge to thereby rebound the upper member upwardly to its normal position which projects upwardly from the surface of the road.

36 Claims, 3 Drawing Sheets

U.S. PATENT DOCUMENTS 5,061,114 10/1991 Hedgewick .
5,069,577 12/1991 Murphy .
5,074,706 12/1991 Paulos .
5,078,538 1/1992 Montalbano .
5,104,256 4/1992 D'Avela .
5,128,203 7/1992 LaRoche .
5,173,099 12/1992 Chen .
5,226,745 7/1993 Gartlacher .
5,240,344 8/1993 Green .
5,257,875 11/1993 Flanagan .
5,267,809 12/1993 Allan .
5,302,048 4/1994 Paulos et al. .
5,308,186 5/1994 Hedgewick .
5,310,279 5/1994 Lindner .
5,340,231 8/1994 Steere et al. .
5,354,143 10/1994 Lindner .
5,393,166 2/1995 Stock et al. .
5,403,115 4/1995 Flader .
5,425,596 6/1995 Steere et al. .
5,449,244 9/1995 Sandino .
5,454,664 10/1995 Siblik .
5,470,170 11/1995 Lindner .
5,513,924 5/1996 Alghunaim .
5,529,430 6/1996 Jenkins .
5,564,854 10/1996 Hedgewick .

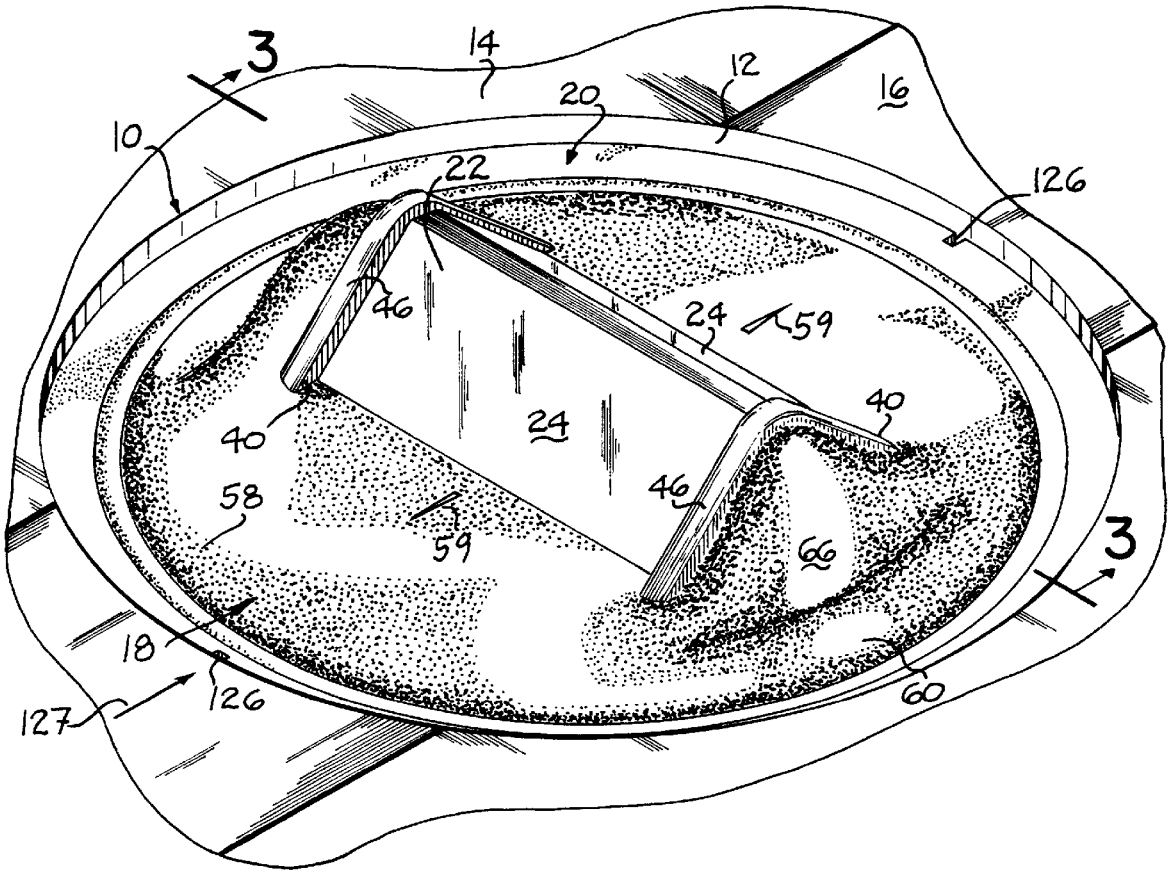
FIG. 1
FIG. 4
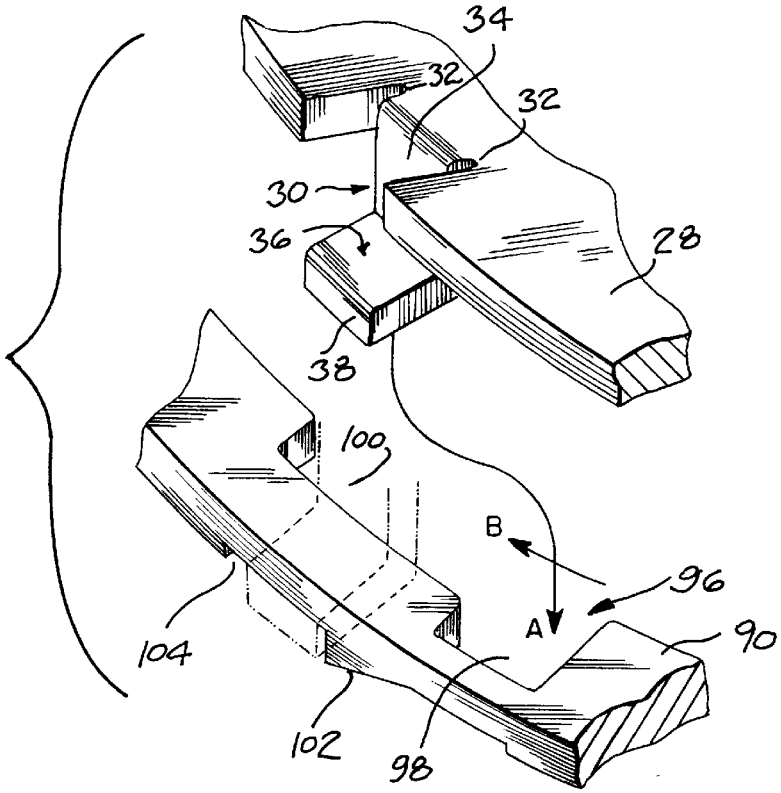

ROADWAY REFLECTOR

BACKGROUND OF THE INVENTION

This invention relates generally to a roadway reflector, and more particularly, to a reflective pavement marker for delineating traffic lanes and other areas on roadways, parking lots or the like.

The advantages of roadway lane markers to delineate traffic paths for drivers are self evident particularly from a safety perspective to advise drivers of the lane. Reflective paving markers are more desirable than painted dividing lines between traffic lanes or the like because such reflective markers are more visible to a driver over a greater distance and will function better in many instances where painted traffic lines are seen by a driver only with much difficulty such as on wet roadways, snow covered roadways or in foggy driving conditions. Further, many roadway markers provide an audible and/or tactile signal to the driver whose vehicle contacts the marker.

Thus, in order to overcome the shortcomings of painted traffic lines, roadway markers have been used. Typically, the roadway marker includes a reflective element to re-direct incident light from the head lamps of a driver's vehicle or oncoming vehicles and thereby advise the driver of the boundaries of the traffic lanes. One type of known roadway marker is surface mounted on the roadway and secured directly to the upper surface of the roadway. Surface mounted markers are more widely utilized in warmer climates where the markers would not be subject to the sheering effects of a snow plow blade. Alternatively, reflectors embedded in the roadway have found application in many areas. Typically, the physical location of embedded markers makes them more suitable for roadways subject to more sever weather conditions.

One shortcoming of many reflectors or markers is that the snow plow generally pulls the surface mounted reflector unit or embedded reflector from the road and, in most cases, also rips away subjacent and/or adjacent surface road material. Not only is the reflector itself destroyed or damaged so as to require replacement, but as a part of the replacement process, the road surface material ripped away must be repaired or restored. Thus, these devices are not cost effective where snow plowing is necessary to maintain the road clear.

In order to withstand the forces of oncoming snow plow blades and vehicular traffic, a variety of retractable roadway reflectors or markers have been developed. The retractable reflector or marker, although it typically protrudes above the road surface, may be depressed by the blade of a snow plow or vehicle tire. Such markers have incorporated conical springs for biasing the reflector upwardly or foam rubber cells for facilitating the depression and rebounding action of the reflector. However, the effects of dirt, grime, foreign debris, freezing and melting water, snow, rainwater and forces associated with road traffic all detrimentally effect the long term utility of known retractable reflectors. Still other retractable reflectors cannot withstand the scraping effect of the snow plow blades or other items passing over the reflector.

A significant disadvantage of known pavement markers is the tendency for the reflector to become damaged and require repair. Roadway reflectors or markers used in the past require removal of the entire assembly from the roadway to effect a repair. This proves to be very disruptive to traffic, time consuming and, as a result, costly.

Furthermore, roadway reflectors which have proven to be durable and reliable in use typically are very expensive to manufacture and/or install in the roadway. Due to the very large number of reflectors required to delineate traffic lanes for the hundreds of thousands miles of roadways both in existence and under construction, the unit cost for each roadway reflector must be minimized to offer an economically viable safety measure. Additionally, the installation procedures for a roadway marker must be simple, efficient and quickly accomplished in order to contribute to the economic feasibility of the unit.

SUMMARY OF THE INVENTION

The present invention is directed to an improved roadway reflector or marker which can be quickly, easily and efficiently installed in an opening in the roadway while still providing a durable and easily assembled unit.

Moreover, this invention is a roadway reflector which is at least partially embedded in the opening in the roadway so that an upper portion of the reflector projects above the surface of the roadway, and the exposed portion is entirely reflective including a reflector element.

Furthermore, the roadway reflector includes an upper member and a base member which can be easily assembled together to form the unit. When assembled together and installed in the roadway, the upper member advantageously deflects downwardly into the base member in response to an item passing over the reflector such as the blade of a snow plow or tire of a vehicle. After the item passes the marker or reflector, the upper member rebounds upwardly to once again project above the roadway surface. Advantageously, the rebounding force of the upper member propels debris, water, snow and/or ice off of the reflector to maximize the reflective capability of the device.

Specifically, in a presently preferred embodiment of the roadway reflector, the upper member includes a generally circular metal disk with a number of tabs spaced around the perimeter of the disk. Additionally, a pair of generally triangular shaped ramps project upwardly from an upper surface of the metal disk. A reflector element is positioned between the ramps atop the metal disk. The reflector element is bonded to the metal disk by a polymeric material covering the disk. The polymeric material may be a pliable plastic or solid or dense rubber component and extends beyond the perimeter of the metal disk to form a flange. The polymeric material of the upper member covers a pair of hummocks which project upwardly from the upper surface of the metal disk.

The hummocks are spaced on either side of the reflector element and are positioned so that an approaching snow plow blade or the like initially contacts one of the hummocks prior to encountering the ramps. As the item passes over the ramps, the upper member deflects downwardly into the base member. Preferably, the height of each hummock is less than the depth of the polymeric material covering the upper member. The polymeric material serves two primary functions which are bonding the respective elements of the upper member together and providing a bright reflective surface to the reflector.

A presently preferred embodiment of the base member includes an annular wall which has a resilient web or membrane formed around the inside upper edge of the wall. The resilient membrane and annular wall are also manufactured of a pliable or flexible plastic or solid or dense rubber polymeric material. A metal ring is bonded to the inner circumference of the resilient web. A plurality of spaced notches are formed around an interior edge of the metal ring. The notches are sized and configured to mate with the tabs projecting from the perimeter edge of the metal disk of the upper member so that when the respective tabs and notches are aligned and inserted in one another, the upper member can be rotated relative to the lower member to thereby lock and couple the two members together.

An expansion ring is seated within the interior of the annular wall of the base member. The expansion ring includes a generally V-shaped expansion joint so that when the base member and expansion ring are inserted into a circular opening in the roadway, an installer simply actuates the expansion joint to expand the expansion ring and force the annular wall into a friction fit with the side wall of the opening in the roadway. At the same time, the expansion ring helps support the side wall of the opening in the road way (asphalt or concrete) and counteract wheel load forces which may act to collapse or breakdown the side wall. Access is easily provided to the expansion joint through the metal ring of the base member prior to mating the base member with the upper member. After the expansion ring is enlarged and the base member and expansion ring are securely seated in the opening of the roadway, the installer couples the upper member to the base member by aligning the tabs with the notches, inserting them therein and rotating the upper member.

The present invention provides a durable and economically manufactured roadway reflector which can be easily and efficiently installed into an opening in the roadway. Furthermore, the reflector is capable of withstanding the impact from a vehicle tire or snow plow blade by being depressed downwardly into a cavity formed in the reflector. Moreover, this invention not only contemplates the roadway reflector itself but a method of manufacturing such a roadway reflector and a roadway reflector manufactured by that method.

BRIEF DESCRIPTION OF THE DRAWINGS

The objectives and features of the invention will become more readily apparent from the following detailed description taken in conjunction with the accompanying drawings in which:

FIG. 1 is a perspective view of a presently preferred embodiment of a roadway reflector according to this invention embedded in an opening of a roadway;

FIG. 4 is an enlarged partial perspective view of a tab being mated with a notch to couple the upper member and base member of the roadway reflector according to a presently preferred embodiment of this invention.

DETAILED DESCRIPTION OF THE INVENTION

Figure 2:
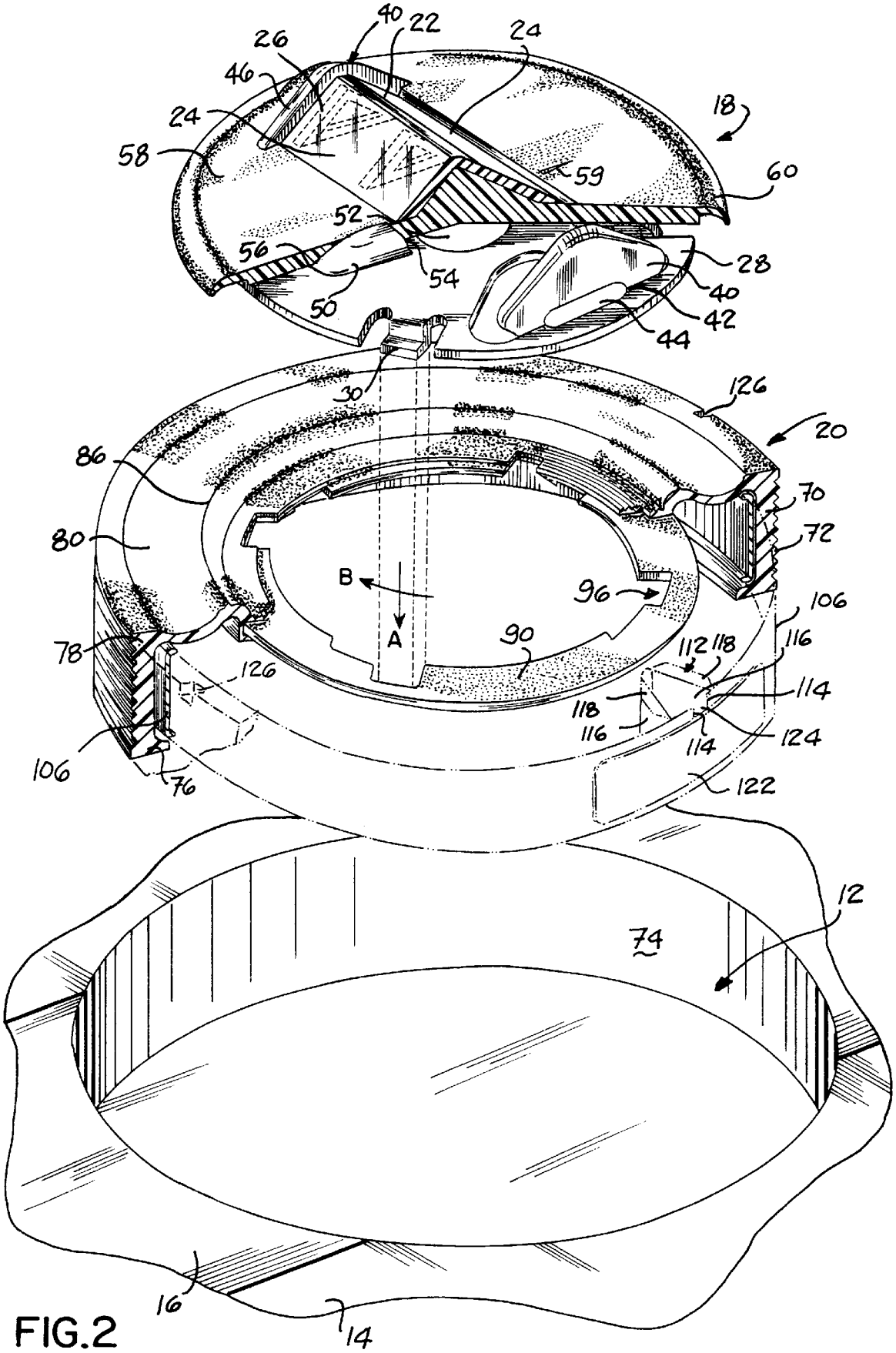
FIG. 2 is a partially exploded perspective view of the upper member and base member of the roadway reflector of FIG. 1 prior to installation into the opening in the roadway.
Figure 3:
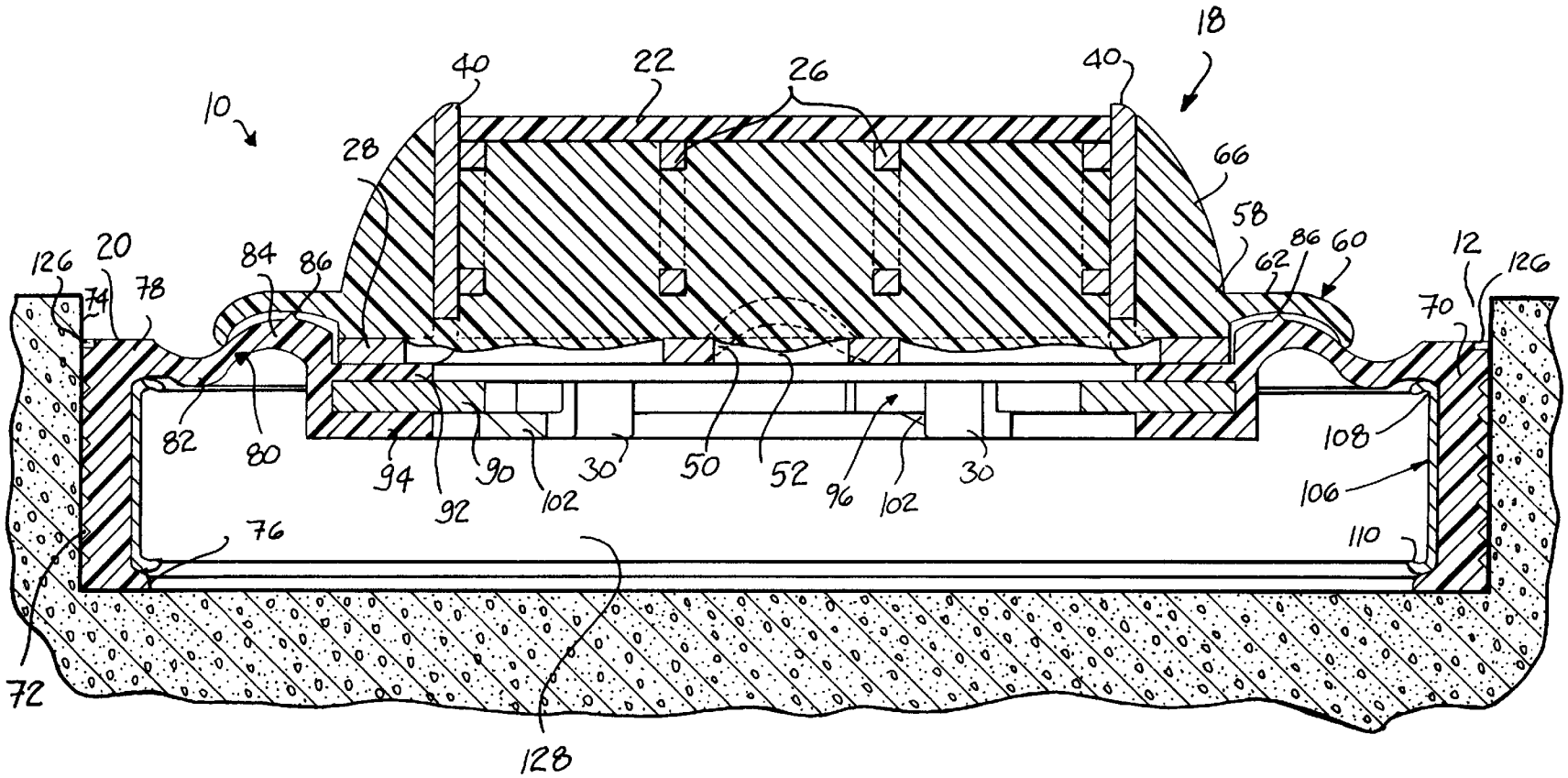
FIG. 3 is a cross-sectional view taken along line 3—3 of FIG. 1.

Referring to FIG. 1, a presently preferred embodiment of a roadway reflector 10 according to this invention is shown. The roadway reflector 10 is at least partially embedded in a circular opening or hole 12 in a roadway 14 and may be located along a lane marking 16 of the roadway 14. The roadway reflector 10, according to a presently preferred embodiment of this invention includes a generally circular upper member 18 which is coupled to a generally circular or disk shaped base member 20. The upper member 18 includes a reflector element 22 having first and second sloped faces 24. The sloped faces 24 are supported by a number of spaced, internal triangular shaped reinforcing ribs 26 (FIGS. 2 and 3). Preferably, each face 24 of the reflector element 22 is angled between about 10° and about 70° and more preferably at approximately 35° with respect to a horizontal plane in order to provide for optimum reflectivity from the element. Additionally, each face 24 of the reflector element 22 is preferably about 0.750 inches in length and the reflector element 22 is preferably about 3.5 inches in width. With the exception of the reinforcing ribs 26, the reflector element 22 is open or hollow on the inside. Preferably, the reflector element 22 is oriented perpendicularly to the direction of traffic flow or the traffic lane marker 16 as shown in FIG. 1. The reflector element 22, according to a presently preferred embodiment of the invention, is a highly retroreflective reflector device which are well known in the industry and typically comprise a plastic member with a metal film backing.

Referring additionally to FIGS. 2–4, the upper member 18 of the roadway reflector 10, according a presently preferred embodiment, includes a metal disk 28 preferably stainless steel type #304 stamped from 11 gauge stock and has a 4.5 inch diameter. The metal disk 28 includes a plurality of tabs 30 around a perimeter edge thereof and are preferably four in number. The width of each tab 30 is preferably 0.375 inches. As shown particularly in FIGS. 2 and 4, each tab 30 is positioned between a pair of slits 32 projecting inwardly from the perimeter edge of the disk 28 and each tab 30 has a generally L-shaped configuration in which a first leg 34 of the L-shaped tab 30 extends downwardly 0.171 inches from the lower surface of the metal disk 28. A second leg 36 of the L-shaped tab 30 projects outwardly toward the perimeter edge of the disk 28 and is preferably 0.218 inches in length and includes a downward taper at an outer end thereof which projects angularly downward at an angle of about 4° to assist in assembly and installation. Preferably, the downwardly angled portion 38 of the second leg 36 of the L-shaped tab 30 is approximately 0.375 inches in width.

A pair of spaced ramps 40 project upwardly from the metal disk 28 and have a generally triangular shaped configuration with rounded 0.94 inch radius apexes proximate its base and a 0.500 radius shaped top. Each ramp 40 is approximately 0.875 inches in height and 2.0 inches in length according to a presently preferred embodiment. Each ramp 40 is cut or punched from the metal disk 28 and then bent upwardly along a base 42 of the ramp 40 so that it projects generally perpendicularly with respect to the disk 28. An oval shaped cut-out 44 is preferably included along the base 42 as shown in FIG. 2 in order to allow the polymeric material to better encapsulate the disk 28. A pair of sloped surfaces 46 of each ramp are each angled 36° 24' relative to horizontal.

A pair of hummocks 50 are spaced on either side of the reflector element 22 as shown particularly in FIG. 2. The hummocks 50 are equally spaced and diametrically positioned on either side of a central and preferably 1.0 inch diameter circular hole 52 in the metal disk 28 which underlies the reflector element 22. Each hummock, mound or protuberance 50 is stamped or punched from the metal disk 28 and includes an open end 54 and a smoothly continuous curved closed end 56 directed away from the reflector element 22. The pair of hummocks 50 are diametrically opposite each other and equally spaced between the ramps 40 on the metal disk 28. Preferably, the maximum height of each hummock 50 is approximately 0.266 inches above the upper surface of the metal disk 28 and each hummock 50 slopes 2° 21' degrees downwardly toward the closed end 56 thereof. Each tab 30 is positioned angularly 35° from the nearest hummock 50.

A third component of the upper member 18 according to a presently preferred embodiment of the roadway reflector 10 of this invention is a polymeric material or polymeric covering 58. The polymeric material 58 is preferably a flexible or pliable plastic or solid or dense rubber such as Hypalon™ which is commercially available from the DuPont Dow Company located in Wilmington, Dl. Other elastomeric materials which have colorability such as Engage™ or EPDM™ may also be used. Preferably, the polymeric covering 58 covers substantially the entire surface of the metal disk 28 with the exception of the ramps 40 and an upper portion 59 of each hummock 58 which project upwardly from the top surface of the polymeric covering 58. Additionally, the polymeric covering 58 is used to bond the reflector element 22 to the metal disk 28, fills the internal hollow cavity of the reflector element 22 and is preferably a colored compound which is reflective and may be white/white, safety yellow, red or another appropriate color.

Preferably, the polymeric material 58 includes a plurality of glass or ceramic beads which are clear or white for reflectivity. During manufacture of the upper member 18, the beads are retained on the surface of a cavity of a mold used to form the polymeric material 58 by an epoxy or other suitable material prior to injecting the colored compound used to form the covering 58. After vulcanization of the covering 58 in the mold, the unit is removed from the mold and the surface upon which the beads were molded is shot blasted to expose preferably 40% of the surface area of the beads by removing the epoxy or other suitable material used as a binder. As a result, the beads are retained on the surface of the covering 58 and a portion of the beads are exposed so that as light impacts the beads it is reflected from the underlying covering 58 and back through the beads. During manufacture, the beads are retained in The polymeric material 58 is preferably both flexible and pliable and extends beyond the perimeter of the metal disk 28 to form a perimeter flange 60 as is shown particularly in FIGS. 2 and 3. The flange 60 includes a generally horizontal portion 62. The radial length of the flange 60 is preferably about 0.5 inches. The polymeric material 58 also forms a smoothly rounded shoulder 66 on an outer face of each ramp 40 as shown particularly in FIG. 3.

In a presently preferred method of manufacturing the roadway reflector 10 according to this invention, the polymeric material 58 is not only used as a covering for the upper member 18 but is also employed as a bonding mechanism for securing the reflector element 22 to the circular disk 28. Specifically, the polymeric material 58 in a molten or unhardened state is caused to flow into the cavity within the reflector element 22 that is positioned between the ramps 40. Similarly, polymeric material 58 is caused to flow into the cavity created beneath each hummock 50. One possible manufacturing method according to this invention is the use of an appropriately configured mold into which the metal disk 28 and reflector element 22 as described are positioned and the molten or liquid polymeric material 58 is injected into the mold and vulcanized thereby joining respective components of the upper member 18 together. Preferably, the polymeric material 58 is allowed to vulcanize for a period of 10 minutes at a temperature of 300° F. and then cooled at room temperature.

The base member 20, according to a presently preferred embodiment of this invention, includes an annular wall 70 as shown particularly in FIGS. 2 and 3 which is also preferably molded from a polymeric material such as flexible, pliable plastic or solid or dense rubber and may be manufactured from Neoprene™ or EPDM™ which are commercially available from DuPont Dow located in Wilmington, Dl. Preferably, the annular wall 70 includes a series of serrations 72 on an outer surface thereof which extend around the perimeter of the annular wall 70 to increase the frictional interaction between the annular wall 70 and a side wall 74 of the circular-opening 12 in the roadway 14 (FIG. 3). Preferably, the annular wall 70 includes a bottom flange 76 and a top flange 78 which is integrally formed with a resilient member, web or membrane 80. The resilient web or membrane 80 in cross-sectional configuration as shown in FIG. 3 includes an outer well portion 82 which merges into a raised rounded portion 84 having an inverted V-shaped ridge 86 projecting upwardly therefrom. Bonded to the annular wall 70 and resilient membrane 80 is a metal ring 90 which is preferably carbon steel and positioned between an upper and a lower rim 92, 94 respectively, formed with the resilient membrane.

As shown particularly in FIGS. 2 and 4, a plurality of compound notches 96 are formed around an inner edge of the ring 90. Preferably, the compound notches 96 are four in number and are sized and positioned to mate with tabs 30 projecting from the perimeter edge of the disk 28.

Preferably each compound notch 96 includes a major portion 98 having a width of preferably about 0.5 inches and a depth of about 0.375 inches and a more shallow minor portion 100 which preferably has a width of about 0.75 inches and a depth of about 0.15625 inches.

The steel ring 90 is preferably 11 gauge carbon steel with the exception of a region underlying each minor portion of each compound notch. A tapered detent 102 is molded to the bottom surface of the metal ring 90 and underlies the minor portion 100 of each compound notch 96. The tapered detent 102 has a maximum height of 0.125 inches and includes a sloped face with a slope angle of about 30°. A narrow end of the tapered detent 102 is adjacent the major portion 98 of the notch 96 and adjacent the apex of the tapered detent 102 is a recess 104 on the bottom surface of the metal ring 90 underlying the minor portion 100 of each compound notch 96. The recess 104 is preferably 0.5 inches in width, the metal ring 90 has an outside diameter of about 4.625 inches and inside diameter of 3.5 inches with the exception of the compound notches 96 in the ring.

Preferably the bottom surface of the ring 90 has polymeric material bonded thereto at a thickness of about 0.156 inches to serve as a bumper or protector to the tabs of the upper member from striking the bottom surface of the hole or opening in the roadway in addition to providing a sound deadening effect if the metal ring strikes the roadway.

Similar to the manufacturing and bonding process employed with respect to the upper member 18, the base member 20 is manufactured using a similar vulcanization process to bond the metal ring 90 between the rims 92, 94 connected to the resilient membrane 80 and annular wall 70. Preferably, the polymeric portion of the base member 20 is black in color and has an outer diameter of 6.96875 inches. The vulcanization bonding process and forming method of the base member 20 may include injecting a liquid or molten polymeric material into an appropriately configured mold and then allowing it to vulcanize at a temperature of 300° F. for 10 minutes and thereby bond the polymeric material of the base member 20 to the metal ring 90.

An expansion ring is preferably seated within the annular wall of the base member between the flanges 76, 78 as shown particularly in FIGS. 2 and 3. The expansion ring 106 has a generally C-shaped cross-sectional configuration with an upper curved edge 108 and a lower curved edge 110. The expansion ring 106 includes a preferably V-shaped expansion joint 112 joining terminal ends 114 of the ring 106 in which each leg 116 of the V-shaped expansion joint 112 includes upper and lower flanges 118. Each leg 116 is connected proximate the associated terminal end 114 of the expansion ring 106 as by spot welding or the like. Preferably, the expansion ring 106 and expansion joint 112 are fabricated from carbon steel. An overleaf 122 is attached near one terminal end 114 of the expansion ring 106 across a gap 124 between the terminal ends 114 of the expansion ring 106. The overleaf 122 is connected as by spot welding or the like to only one terminal end 114 of the expansion ring 106 on the outer wall thereof. The expansion ring 106, prior to actuation of the expansion hinge 112, has an outer diameter of approximately 6.375 inches and a height of 1.25 inches. After expansion, the ring 106 is about 6.75 inches in diameter.

One presently preferred method of assembling and installing the various components of the roadway reflector 10 according to this invention will now be described. After the components of the upper member 18 including the reflector element 22 and metal disk 28 are bonded together with the polymeric covering material 58 as previously described and after the components of the base member 20 are bonded together including the annular wall 70, resilient membrane 80 and metal ring 90 are bonded together as described, the expansion ring 106 is inserted into the annular wall 70 as shown in FIG. 2 between the bottom flange 76 and top flange 78. The approximately 7.0 inch diameter circular hole 12 with a depth of about 1.75 inches is cut or otherwise formed in the roadway. Next, the base member 20 with expansion ring 90 inserted therein is placed in the hole 12 so that the top surface of the annular wall 70 is approximately 0.25 inches below the road surface. The installer then actuates the expansion hinge 112 by impacting the apex of the V-shaped hinge 112 outwardly toward the side wall 74 of the opening 12 in the road 14 with a hydraulic cylinder operated scissor design or a manual operated screw type scissor design or other appropriate tool as would be readily understood by one of ordinary skill in the art.

When the expansion hinge 112 is actuated, the expansion ring 106 enlarges thereby forcing and compressing the annular wall 70 outwardly against the side wall 74 of the hole 12 and creating a friction fit to retain the base member 20 within the opening 12 in the road 14. Actuation of the expansion hinge 112 urges the terminal ends 114 of the expansion ring 106 apart until the faces of the V-shaped hinge 112 are juxtaposed to the inside surface of the wall of the expansion ring 106. As a result, the base member 20 is securely retained and embedded within the road 14. Care should be taken to properly align the base member 20 in the opening 12 in the roadway 14 with respect to the direction of traffic. Two notches 126 are provided preferably in the upper edge of the annular wall 70 at 180° apart which can be conveniently aligned to be generally parallel with the direction of travel 127 when the reflector 10 is assembled. Preferably, the notches 126 are generally co-linear with the center line of the two hummocks.

Next, the upper member 18 is mated with the base member 20 to thereby complete the assembly and installation of the roadway reflector 10 according to this invention. The tabs 30 in the metal disk 28 are aligned with the respective notches 96 in the metal ring 90 and the upper member 18 is placed on top of the base member 20 so that the tabs 30 pass through the major portion 98 of the aligned compound notch 96 as shown by arrow A in FIGS. 2 and 4. The upper member 18 is then rotated in the direction of arrow B so that the tabs 30 deflect downwardly and ride along the tapered surface of the respective detent 102 until the tabs 30 are rotated past the detent 102 and are aligned with the respective recess 104 in the bottom surface of the metal ring 90 at which time the upper member 18 is coupled to the base member 20 with the tabs 30 seated within the respective recesses 104. As a result, the roadway reflector 10 is assembled and installed in the opening 12 in the roadway 14 so that the upper surface of the reflective covering 58 is generally even with the roadway surface 14 with the shoulders 66, reflector element 22 and ramps 40 projecting upwardly therefrom.

In use, due to the orientation of the reflector element 22 positioned between the ramps 40 and perpendicular to the flow of traffic, light impacting the reflector element 22 is reflected back to the driver to delineate a lane of traffic or the like. Advantageously, the entire exposed surface of the upper member 18 is preferably reflective in that the polymeric covering 58 preferably has a reflective surface and/or is a reflective color of white/white, safety yellow, red or the like. The flange 60 extending around the perimeter of the upper member 18 overlies at least a portion of the resilient membrane 80 of the base member 20 as shown in FIG. 3. The inverted V-shaped ridge 86 preferably projects 1/32 of an inch above the surface of the base member 18 and contacts the under surface of the flange 60 of the upper member 18 thereby forming a seal between the upper member 18 and the base member 20 to inhibit foreign matter such as debris, gravel, sand, salt, water or ice from entering a cavity 128 in the base member 20 below the upper member 18.

In operation, the resilient membrane 80 acts as a hinge for the upper member 18 so that when a vehicle, snow plow blade or other item passes over the roadway reflector 10, the exposed portion of the reflector 10 is depressed downwardly into the cavity 128 in the base member 20 due to the flexing of the resilient membrane 80. After the vehicle tire, snow plow blade or other item passes the reflector 10, the resilient membrane 80 flexes the upper member 18 upwardly thereby rebounding it to its original configuration as shown in FIGS. 1 and 3. The rebound action of the resilient membrane 80 serves to propel the debris, water, ice, dirt, sand or the like which may be covering the reflector 10. As a result, the flexing action of the reflector in response to an item passing over it not only serves to protect the reflector 10 from damage or the like but enhances its effectiveness by propelling debris or other foreign matter from the reflector 10 which would obstruct light impacting the reflective surfaces of the upper member 18.

The upper curved edge 108 of the expansion ring 106 is rounded so that when the upper member 18 is deflected downwardly into the cavity 128 of the base member 20, the resilient member 80 and annular wall 70 are not damaged, cut or severed by the expansion ring 106 during the flexing of the resilient membrane 80.

As an item approaches the reflector 10, particularly the blade of a snow plow or the like, it initially contacts the covering 58 at some point near the flange 60 of the polymeric covering 58 and then the closed formed end 56 of one of the hummocks 50 to thereby deflect the reflector downward. As the blade continues across the reflector 10 it then contacts the edges 46 of the ramps 40. Since the reflector element 22 is recessed below the upper edges of the ramps 40, it is protected from contact by the snow blade or the like. As the snow blade or the like maintains contact with the ramps 40, the reflector 10 continues to be depressed downwardly as the resilient membrane 80 acts as a hinge until the snow plow blade or other item passes the reflector 10 and the resilient membrane 80 urges the upper member 18 upwardly to its original position as shown in FIGS. 1 and 3.

It will be appreciated by one of ordinary skill in the art that the roadway reflector 10, according to this invention, is easily and economically manufactured and efficiently assembled on site in an opening in the roadway. Further, the component materials and design of the roadway reflector 10 offer a very durable and resilient item for many years of use. However, if the upper member 18 becomes damaged and is in need of repair or replacement, it could be rotated in the opposite direction of arrow B of FIG. 2 to thereby disengage the tabs 30 from -their respective recesses 104 until the tabs 30 are aligned with the major portion 98 of the compound notch 96 thereby enabling the upper member 18 to be removed. The upper member 18 can then be repaired and re-installed or a new upper member or replaced according to the installation procedure previously described herein.

From the above disclosure of the general principles of the present invention and the preceding detailed description of a preferred embodiment, those skilled in the art will readily comprehend the various modifications to which this invention is susceptible. Therefore, I desire to be limited only by the scope of the following claims and equivalents thereof.

I claim:

1. A roadway reflector comprising:

an upper member being generally circular and having a reflective portion;

a base member being generally circular and adapted to be inserted into an opening in a roadway so that the base member is at least partially embedded in the roadway;

a plurality of connector elements sized and configured to mate with a plurality of mating connector elements so that rotational movement of the upper member relative to the base member couples them together so that the upper member projects above the roadway when the base member is inserted into the opening, wherein the plurality of connector elements are on one of the upper member and the base member and the plurality of mating connector elements are on the other one of the upper member and the base member; and an annular resilient member integrally formed with the base member so that when an item contacts the upper member the resilient member permits the upper member to deflect downwardly and at least partially into the base member and then rebound upwardly after the item passes the reflector.

2. The reflector of claim 1 further comprising:

at least one ramp projecting upwardly from an upper surface of the upper member so that when the reflector is embedded in the roadway the item passing over the reflector contacts the ramp; and a cavity in the base member so that when the item contacts the ramp the upper member is temporarily deflected downwardly into the cavity of the base member until the item passes the reflector.

3. The reflector of claim 2 wherein the reflective portion comprises a reflector element positioned between a first and second ramp and an upper surface of the reflector element is recessed relative to an upper surface of the ramps.

4. The reflector of claim 3 further comprising:

a first and second spaced hummock on the upper member with the reflector element positioned therebetween so that the item passing over the reflector initially contacts one of the hummocks prior to contacting the ramps.

5. The reflector of claim 1 wherein the plurality of mating connector elements comprise tabs which project from a perimeter of a disk of the upper member and the plurality of connector elements comprise notches which are formed on an interior edge of a ring of the base member.

6. The reflector of claim 1 wherein the upper member and the base member each comprise multiple components of dissimilar materials bonded together to form the upper member and the base member, respectively.

7. The reflector of claim 6 wherein the upper member further comprises:

a generally circular metal disk having a plurality of tabs comprising the connector elements spaced around a perimeter of the disk;

a first and second ramp projecting upwardly from the disk;

a reflector element extending between the ramps;

a first and second hummock protruding upwardly from the disk with the reflector element positioned between the first and second hummock so that the item passing over the reflector initially contacts one of the hummocks prior to contacting the ramps; and a polymeric covering bonding the reflector element to the disk and substantially covering the disk and the hummocks with a reflective surface.

8. The reflector of claim 6 wherein the base member further comprises:

an annular wall of polymeric material, the annular wall defining a cavity into which the upper member deflects downwardly in response to contact by the item, the resilient member being integrally formed around an inside upper edge of the annular wall;

a metal ring bonded to the resilient member; and a plurality of notches on the metal ring, wherein the plurality of notches comprise the plurality of connector elements.

9. The reflector of claim 8 further comprising:

an metal expansion ring seated on the annular wall of the base member; and an expansion joint on the expansion ring which upon actuation enlarges the expansion ring to force the annular wall against a sidewall of the opening in the roadway and frictionally retain the reflector in the opening.

10. The reflector of claim 9 further comprising:

a plurality of serrations on the annular wall to enhance the frictional interaction between the base member and the sidewall of the opening; and a rounded upper edge on the expansion ring to minimize damage to the base member when the upper member deflects downwardly.

11. The reflector of claim 1 further comprising:

an annular flange extending around a perimeter of the upper member and at least partially overlying the resilient member, wherein the flange and the resilient member cooperate to inhibit foreign matter from entering the reflector and to expel foreign matter from the reflector when the upper member deflects downwardly into the base member.

12. The reflector of claim 1 further comprising:

an expansion ring seated within the base member; and an expansion joint on the expansion ring which upon actuation enlarges the expansion ring to force an annular wall of the base member against sidewall of the opening in the roadway and both frictionally retain the reflector in the opening and inhibit the sidewall from collapsing as the item passes over the reflector.

13. The reflector of claim 12 wherein the expansion joint comprises a generally V-shaped hinge prior to actuation.

14. A roadway reflector comprising:

a composite upper member being generally circular and including a retroreflective element, a metal disk and a polymeric covering;

a plurality of tabs spaced on a perimeter of the disk;

a composite base member being generally circular and adapted to be inserted into an opening in a roadway so that the base member is at least partially embedded in the roadway, the base member including a polymeric annular wall and a metal ring bonded to the annular wall;

a plurality of notches on an interior edge of the ring, the notches being sized and configured to mate with the plurality of tabs on the disk so that rotational movement of the upper member relative to the base member couples them together so that the upper member projects above the roadway when the base member is inserted into the opening;

an annular resilient member integrally formed with the annular wall of the base member and joining the metal ring with the annular wall so that when an item contacts the upper member the resilient member permits the upper member to deflect downwardly and at least partially into the base member and then rebound upwardly after the item passes the reflector;

a first and second ramp projecting upwardly from the disk so that when the reflector is embedded in the roadway the item passing over the reflector contacts the ramps;

wherein the reflector element is positioned between the first and second ramps and an upper surface of the reflector element is recessed relative to an upper surface of the ramps;

a first and second spaced hummock on the disk with the reflector element positioned therebetween so that the item passing over the reflector initially contacts one of the hummocks prior to contacting the ramps;

wherein the polymeric covering bonds the reflector element to the disk and substantially covers the disk and the hummocks with a reflective surface;

an annular flange extending around a perimeter of the polymeric covering and at least partially overlying the resilient member, wherein the flange and the resilient member cooperate to inhibit foreign matter from entering the reflector and to expel foreign matter from the reflector when the upper member deflects downwardly into the base member;

an expansion ring seated within the base member;

an expansion joint on the expansion ring which upon actuation enlarges the expansion ring to force the annular wall of the base member against a sidewall of the opening in the roadway and frictionally retain the reflector in the opening;

a plurality of serrations on the annular wall to enhance the frictional interaction between the base member and the sidewall of the opening; and a rounded upper edge on the expansion ring to minimize damage to the base member when the upper member deflects downwardly.

15. A method of making a reflector adapted to be embedded into an opening in a roadway, the method comprising:

bonding a reflector element to a generally circular metal disk between a first and second ramp projecting upwardly from the disk so that the reflector element is recessed relative to an upper surface of the ramps, the disk having a plurality of connector elements spaced around a perimeter thereof;

bonding a metal ring to a resilient web which is integrally formed with an annular wall, the ring having a plurality of mating connector elements;

aligning the plurality of connector elements on the disk with the plurality of mating connector elements on the ring; and coupling the disk and the ring to each other by engaging the connector elements with the mating connector elements.

16. The method of claim 15 wherein the coupling step further comprises:

rotating the disk and the ring relative to each other.

17. The method of claim 15 further comprising:

inserting an expansion ring within the annular wall, the expansion ring including an expansion joint which upon actuation enlarges the expansion ring to force the annular wall against a sidewall of the opening in the roadway when the reflector is placed therein.

18. The method of claim 15 wherein the bonding of the reflector element to the disk further comprises:

covering the disk with a polymeric material having a reflective surface.

19. The method of claim 18 further comprising:

covering a first and second hummock on the disk with the polymeric material, the reflector element being positioned between the first and second hummock.

20. The method of claim 19 further comprising:

filling the reflector element and the first and second hummock with the polymeric material.

21. The method of claim 18 wherein the bonding of the reflector element to the disk and the bonding of the ring to the resilient web each comprise vulcanizing the metal disk to the polymeric material and the metal ring to the resilient web, respectively, wherein the resilient web is a polymeric material.

22. The method of claim 18 wherein the covering of the disk with the polymeric material further comprises:

forming a flange with the polymeric material so that the flange at least partially covers the resilient web bonded to the metal ring.

23. The method of claim 18 further comprising:

forming a shoulder with the polymeric material proximate a side of each of the ramps opposite the reflector element.

24. The method of claim 15 wherein the coupling further comprises:

inserting a plurality of tabs projecting from the disk into a plurality of notches in the ring, wherein the tabs comprise the connector elements and the notches comprise the mating connector elements;

temporarily deflecting the plurality of tabs as they engage a plurality of sloped detents on the ring during the rotating of the disk and the ring relative to each other; and seating the plurality of tabs in a plurality of recesses in the ring to thereby couple the disk and the ring to each other.

25. The method of claim 15 further comprising:

bonding a plurality of beads to a covering on the disk to provide a reflective surface to the disk.

26. The method of claim 25 further comprising:

exposing a portion of at least some of the plurality of beads to permit light to pass therethrough and reflect off of the covering on the disk.

27. A reflector manufactured from a method comprising:

bonding a reflector element to a generally circular metal disk between a first and second ramp projecting upwardly from the disk so that the reflector element is recessed relative to an upper surface of the ramps, the disk having a plurality of connector elements spaced around a perimeter thereof;

bonding a metal ring to a resilient web which is integrally formed with an annular wall, the ring having a plurality of mating connector elements;

aligning the plurality of connector elements on the disk with the plurality of mating connector elements on the ring; and coupling the disk and the ring to each other by engaging the connector elements with the mating connector elements.

28. The reflector of claim 27 wherein the coupling step further comprises:

rotating the disk and the ring relative to each other.

29. The reflector of claim 27 further comprising:

inserting an expansion ring within the annular wall, the expansion ring including an expansion joint which upon actuation enlarges the expansion ring to force the annular wall against a sidewall of the opening in the roadway when the reflector is placed therein.

30. The reflector of claim 27 wherein the bonding of the reflector element to the disk further comprises:

covering the disk with a polymeric material having a reflective surface.

31. The reflector of claim 30 further comprising:

covering a first and second hummock on the disk with the polymeric material, the reflector element being positioned between the first and second hummock.

32. The reflector of claim 31 further comprising:

filling the reflector element and the first and second hummock with the polymeric material.

33. The reflector of claim 30 wherein the bonding of the reflector element to the disk and the bonding of the ring to the resilient web each comprise vulcanizing the metal disk to the polymeric material and the metal ring to the resilient web, respectively, wherein the resilient web is a polymeric material.

34. The reflector of claim 30 wherein the covering of the disk with the polymeric material further comprises:

forming a flange with the polymeric material so that the flange at least partially covers the resilient web bonded to the metal ring.

35. The reflector of claim 30 further comprising:

forming a shoulder with the polymeric material proximate a side of each of the ramps opposite the reflector element.

36. The reflector of claim 27 wherein the coupling further comprises:

inserting a plurality of tabs projecting from the disk into a plurality of notches in the ring, wherein the tabs comprise the connector elements and the notches comprise the mating connector elements;

temporarily deflecting the plurality of tabs as they engage a plurality of sloped detents on the ring during the rotating of the disk and the ring relative to each other; and seating the plurality of tabs in a plurality of recesses in the ring to thereby couple the disk and the ring to each other.

* * * * *